US007716789B1

(12) United States Patent
Zevallos

(10) Patent No.: US 7,716,789 B1
(45) Date of Patent: May 18, 2010

(54) SANITARY HANDLE APPARATUS

(76) Inventor: Emanual Zevallos, 8810 Ida La., Sandy, UT (US) 84093

( * ) Notice: Subject to any disclaimer, the term of this patent is extended or adjusted under 35 U.S.C. 154(b) by 0 days.

(21) Appl. No.: 12/242,055

(22) Filed: Sep. 30, 2008

(51) Int. Cl.
*A45C 7/00* (2006.01)

(52) U.S. Cl. ..... 16/412; 16/904

(58) Field of Classification Search ..... 16/412, 16/426, 904, 110.1, 431, 436; 242/364.11
See application file for complete search history.

(56) References Cited

U.S. PATENT DOCUMENTS

| | | | | |
|---|---|---|---|---|
| 2,903,734 | A | 9/1959 | Inman | |
| 4,644,689 | A | 2/1987 | Arians | |
| 4,658,469 | A | 4/1987 | Hawkins | |
| 4,997,139 | A | 3/1991 | Menard | |
| 5,314,668 | A | 5/1994 | Biermaier | |
| 5,975,083 | A | 11/1999 | Henderson, Jr. | |
| D427,046 | S | 6/2000 | Mannix | |
| 6,546,594 | B1 | 4/2003 | Wills | |
| 2009/0145992 | A1 * | 6/2009 | Lavy | 242/364.11 |

* cited by examiner

*Primary Examiner*—William L. Miller
(74) *Attorney, Agent, or Firm*—Crossley Patent Law; Mark A. Crossley

(57) ABSTRACT

The sanitary handle apparatus provides a leveraged handle with a like-shaped rod within. The rod is partially exposed. A protective covering is fed onto the rod to prevent contact with germs and bacteria left by other individuals. The apparatus is especially useful for publicly and industrially used doors. The covering is an automatically feeding roll of hygienic, biodegradable paper or plastic rod covering. The roll is placed inside a durable, plastic or metal housing that operates via 12-volt, rechargeable battery packs and/or 12-volt transformer and also includes a motion sensor for motor activation.

3 Claims, 4 Drawing Sheets

20
57
40
52
50
58
54

62
22
70
30
52
36
32
34
57
71
58
51

SANITARY HANDLE APPARATUS

BACKGROUND OF THE INVENTION

Sanitation contributes to the health of all people, and a sanitation issue well recognized is that of public door handles, such as those used on restroom doors. Providing cleanliness of such handles has long been a challenge, one addressed by previously proposed devices, but a problem yet to be adequately solved. One basic concern is that a properly designed device should be separate from a given door, that is, a separate handle mechanism not requiring door replacement. Doors to publicly used restrooms and industrially used doors are often heavy, sometimes fire rated, and consequently expensive. It is therefore desirable to either install or replace a handle mechanism rather than an entire door, and it is also important to use existing latch mechanisms. Individual disposable handle protection devices have been proposed, but create the issue of disposable waste, an item often resulting in litter.

The amount of space required to sanitize a given door mechanism is of further concern. Most restrooms are already crowded. Further, health codes must be met, and some devices may not conform to such. Handles in the medical field are of concern also. Typical hospital doors, for example, are oversized and heavy, requiring a handle with enough leverage for a person to engage and disengage the latch. Hospital door handles are therefore typically of a leverage type, with extensions beyond that of a rotary knob mechanism. It is further desirable, in the interest of economy, to provide a portion of the handle with a sanitary cover, whereby excessive quantities of sanitation material are not expended. Another reason to provide only a portion of the leveraged handle with sanitary provision is that another part of the handle may need a more industrial surface, for use by gloved workman and the like, wherein the more fragile surfaces covered by the sanitary material are not used for heavy-handed operation of the handle. The present sanitary handle apparatus solves these problems in providing a sanitary means for protecting an individual from touching a handle surface previously touched by another.

FIELD OF THE INVENTION

The sanitary handle apparatus relates to sanitary covering devices and, more particularly, to a sanitary handle device which is used to feed a roll of clean protective cover over a portion of a door handle to prevent the spread of germs and infectious diseases.

SUMMARY OF THE INVENTION

The general purpose of the sanitary handle apparatus, described subsequently in greater detail, is to provide a sanitary handle apparatus which has many novel features that result in an improved sanitary handle apparatus which is not anticipated, rendered obvious, suggested, or even implied by prior art, either alone or in combination thereof.

The present sanitary handle apparatus provides a tubular leveraged handle with a like-shaped rod within. A curved loop of the rod is exposed. Protective covering is fed onto the rod to prevent contact with germs, bacteria, or any undesirable substance left by other individuals or conditions. The apparatus is especially useful for publicly and industrially used doors. The apparatus provides a covering comprising an automatically feeding roll of hygienic, biodegradable paper or plastic handle covering. The roll is placed inside a durable, plastic or metal housing that operates via 12-volt, rechargeable battery packs and/or 12-volt transformer. A light sensor is supplied for activating the motor.

Thus has been broadly outlined the more important features of the improved sanitary handle apparatus so that the detailed description thereof that follows may be better understood and in order that the present contribution to the art may be better appreciated.

An object of the sanitary handle apparatus is to automatically provide a fresh protective cover for each user of door handle.

Another object of the sanitary handle apparatus is to provide needed leverage in opening and closing a heavy door.

A further object of the sanitary handle apparatus is to conserve protective cover.

An added object of the sanitary handle apparatus is to provide for easily renewing the protective cover of the apparatus.

And, an object of the sanitary handle apparatus is to reduce litter.

These together with additional objects, features and advantages of the improved sanitary handle apparatus will be readily apparent to those of ordinary skill in the art upon reading the following detailed description of presently preferred, but nonetheless illustrative, embodiments of the improved sanitary handle apparatus when taken in conjunction with the accompanying drawings.

In this respect, before explaining the current embodiments of the improved sanitary handle apparatus in detail, it is to be understood that the sanitary handle apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved sanitary handle apparatus. It is therefore important that the claims be regarded as including such equivalent constructions insofar as they do not depart from the spirit and scope of the sanitary handle apparatus.

It is also to be understood that the phraseology and terminology employed herein are for purposes of description and should not be regarded as limiting.

DETAILED DESCRIPTION OF THE DRAWINGS

Figure 1:
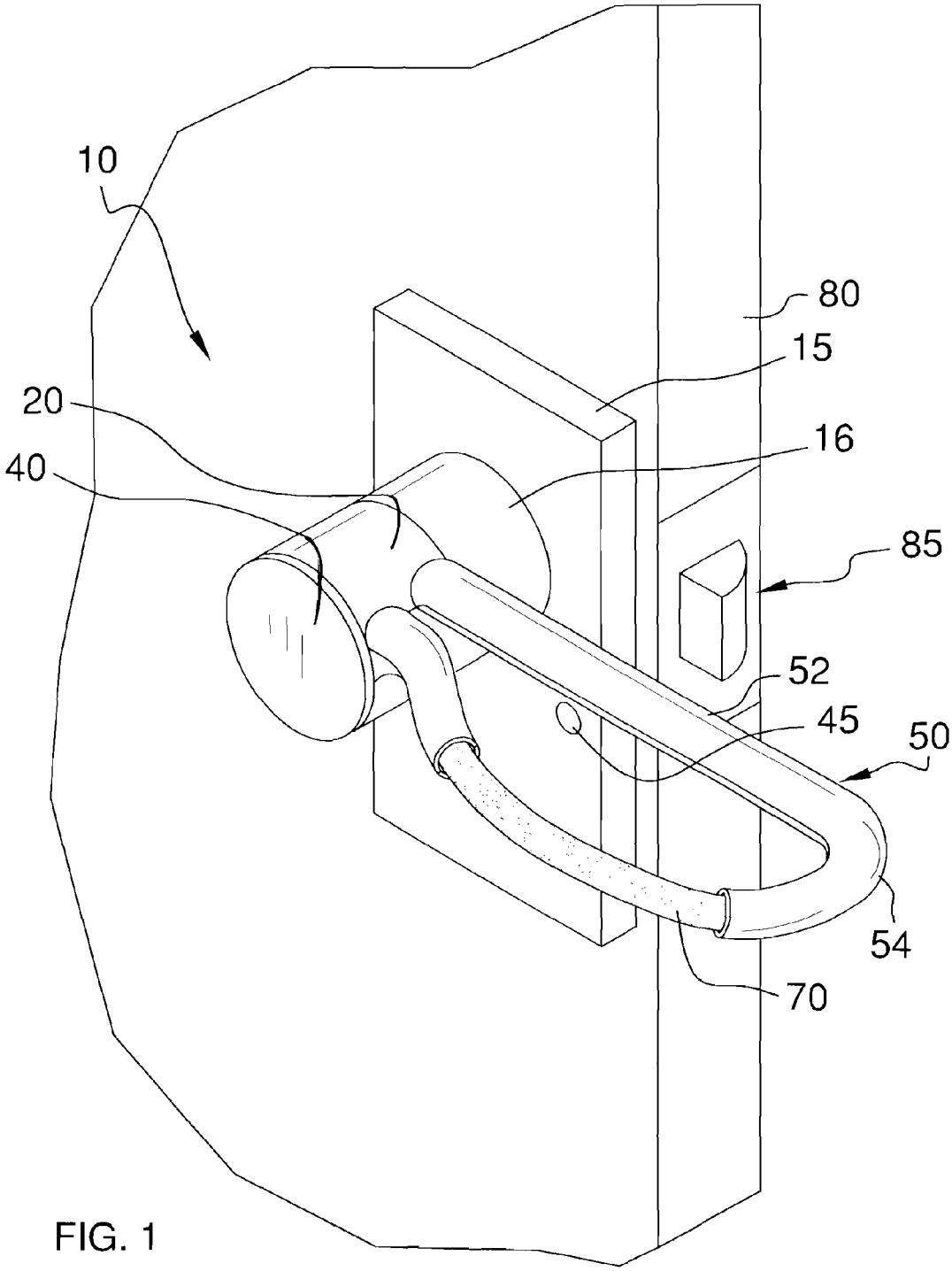
FIG. 1 is a perspective view of the installed apparatus.
Figure 2:
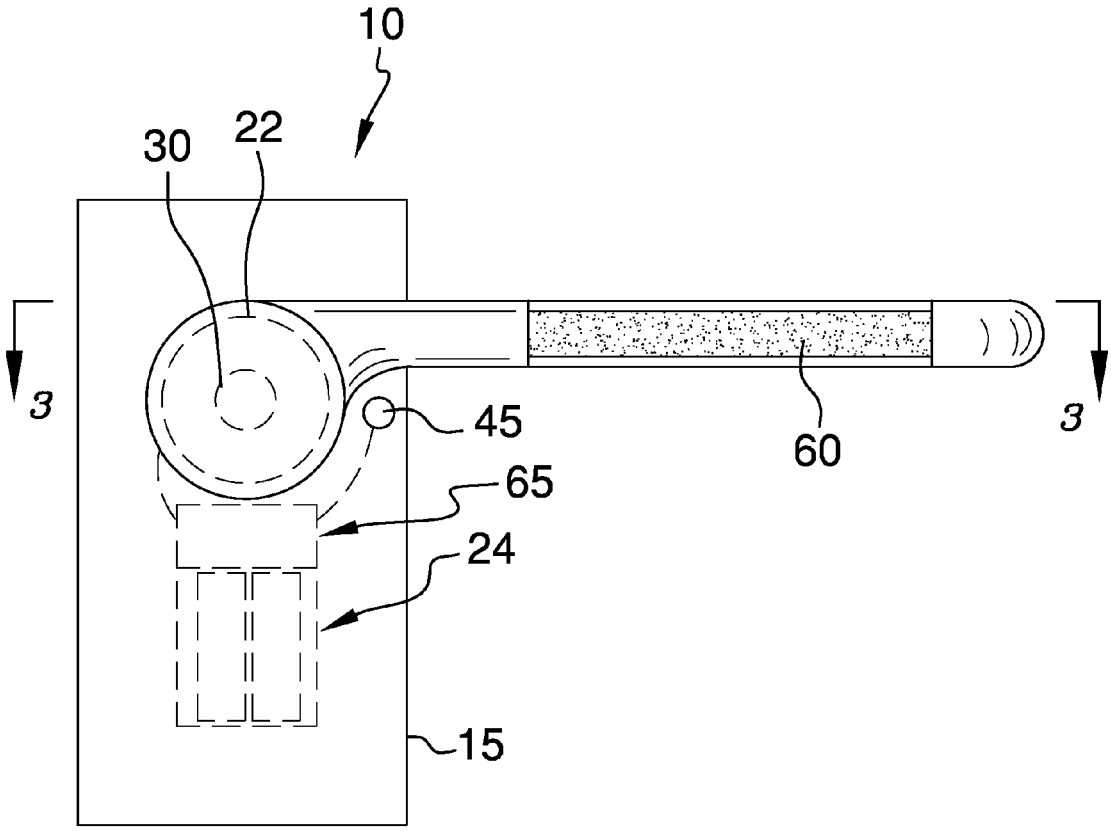
FIG. 2 is a front elevation view of the apparatus.
Figure 3:
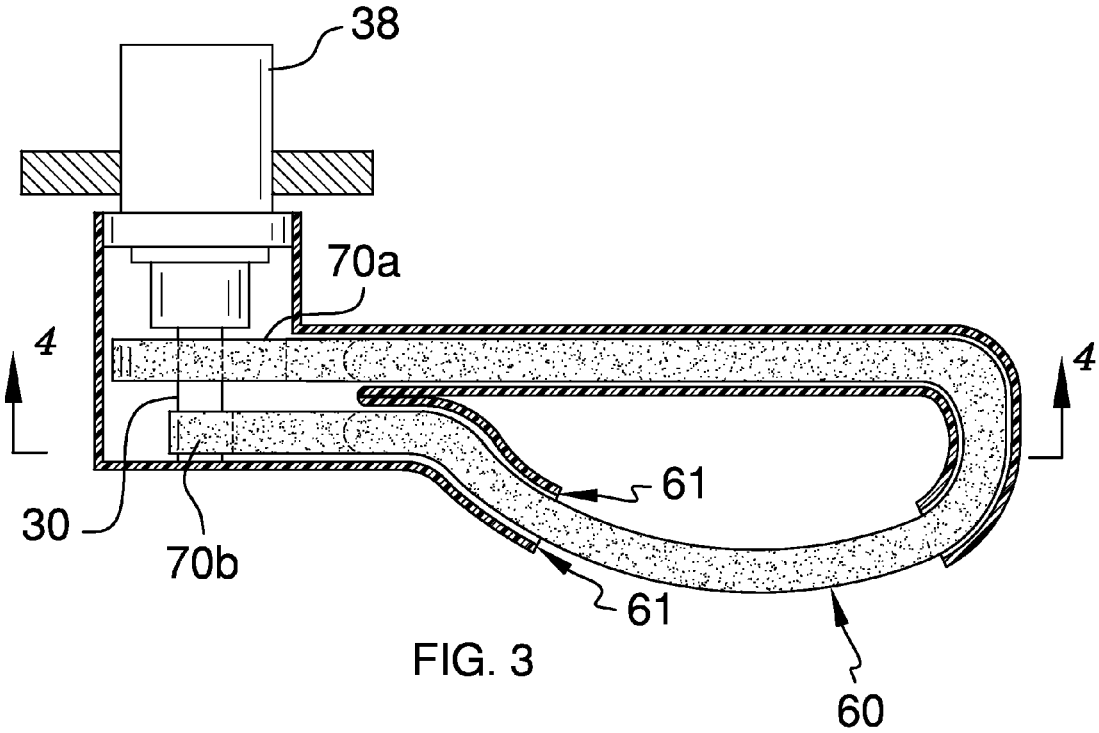
FIG. 3 is a top cross sectional view of FIG. 2.
Figure 4:
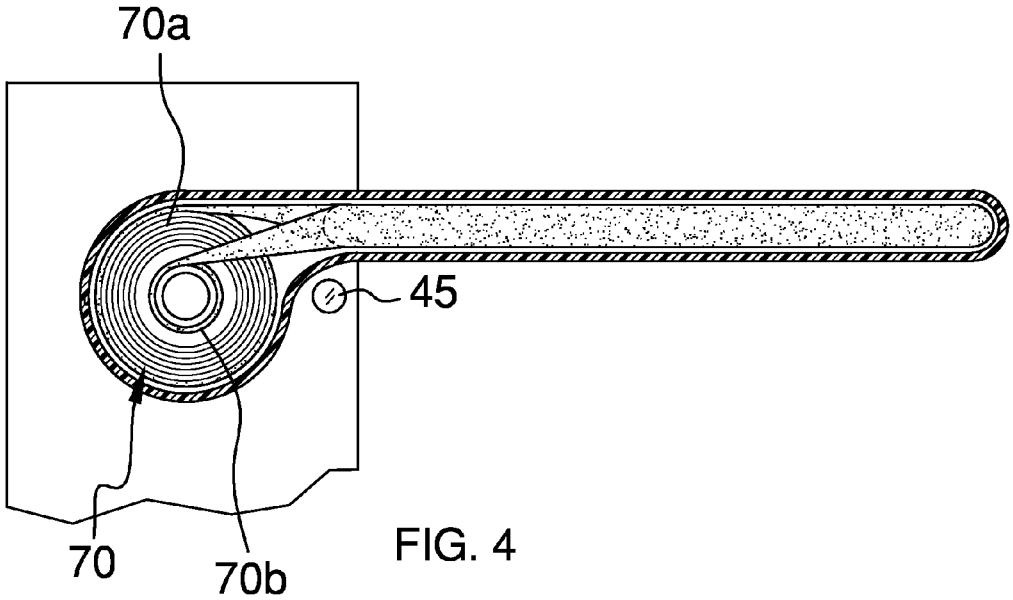
FIG. 4 is a frontal cross sectional view of FIG. 3.
Figure 5:
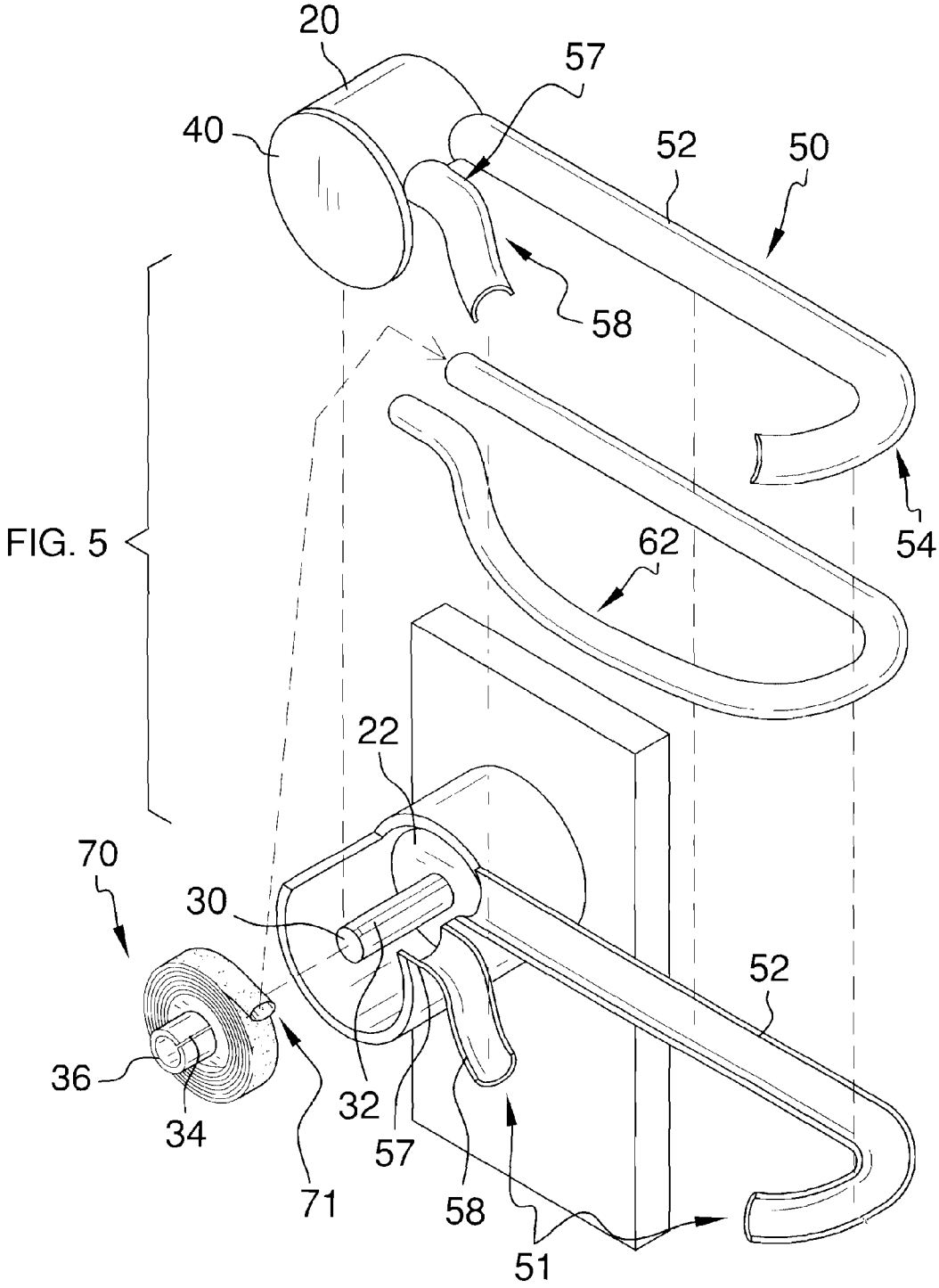
FIG. 5 is an exploded perspective view.

With reference now to the drawings, and in particular FIGS. 1 through 5 thereof, the principles and concepts of the sanitary handle apparatus generally designated by the reference number 10 will be described.

Referring to FIGS. 1-5, the sanitary handle apparatus 10 is fitted to an existing door 80 with latch 85. The apparatus 10 comprises the rectangular mount flange 15 fastened to the door 80 proximal to the latch 85. The cylindrical base 16 is affixed to the exterior of the flange 15. The rotary cylinder 20 is rotatably attached to the base 16. The cap 40 is removably fitted to the rotary cylinder 20. The latch drive 38 is in communication with the rotary cylinder 20 and the door latch 85 whereby rotary movement of the cylinder 20 activates the door latch 85.

The electric motor 22 is disposed within the base 16. The drive pin 30 is provided with an axial key 32 and is rotatably driven by the motor 22. The sleeve 36 has a length. The keyway 34 is axially disposed within the sleeve 36. The sleeve 36 is slideably and removably fitted to the drive pin 30 with the pin key 32 fitted to the keyway 34, whereby the sleeve 36 is driven by the motor 22. The tubular handle 50 is affixed to the rotary cylinder 20. The handle 50 is also known as a leveraged handle 50 due to the important extended tangential arrangement of the handle 50 with regard to the rotary cylinder 20. The handle 50 thereby provides leverage needed to open larger doors 80 and latches 85. The handle 50 further comprises the horizontal transverse 52 with the return bend 54 at the distal end of the transverse 52. The return 57 is affixed to the cylinder 20 adjacent to the transverse 52. The curved bend 58 is extended from the return 57. The gap 51 is disposed between the return bend 54 and the curved bend 58. The rod 60 is fitted within the tubular handle 50 with a space 61 between the rod 60 and the handle 50. The curved loop 62 of the rod 60 is disposed outwardly at the gap 51 of the tubular handle 50. The curved loop 62 is important in that it provides clearance for a hand to operate the handle 50 without having to touch any surface but the rod 60 with protective cover 70. The light sensitive sensor 45 is disposed in the flange 15, whereby the motor 22 is activated by the light sensor 45. The quantity of protective cover 70 comprises unused cover 70*a* and used cover 70*b*. The unused cover 70*a* is supplied wrapped around part of the length of the sleeve 36 with the cover end 71 free. The cap 40 is removed from the cylinder 20. The protective cover 70 is supplied on a replacement sleeve 36 for each protective cover 70 change.

Upon insertion of the new sleeve 36 with cover 70, the cover end 71 is selectively fitted around the rod 60 within the transverse 52. The sensor 45 is used to activate the motor 22 to feed an amount of unused protective cover 70*a* onto the rod 60. The motor 22 is used until a sufficient amount of unused cover 70*a* is fed onto the rod 60 and begun to wrap around the sleeve 36 adjacent to the unused cover 70*a*. The cap 40 is re-installed. Each time proximity of a user's hand operates the door latch 84 via the handle 50, the motor 22 is activated by the sensor 45 via the processor 65 to cause the unused cover 70*a* to unwind from the sleeve 36 and the used cover 70*b* to wind onto the sleeve 36. Only the amount of unused cover 70*a* needed to cover the rod 60 exposed by the gap 51 is dispensed from the unused cover 70*a*. The sensor 45 is in communication with the power source 24 via the processor 65. The processor 65 is in turn in communication with the motor 22.

With respect to the above description then, it is to be realized that the optimum dimensional relationships for the parts of the sanitary handle apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the sanitary handle apparatus.

Directional terms such as "front", "back", "in", "out", "downward", "upper", "lower", and the like may have been used in the description. These terms are applicable to the embodiments shown and described in conjunction with the drawings.

These terms are merely used for the purpose of description in connection with the drawings and do not necessarily apply to the position in which the sanitary handle apparatus may be used.

Therefore, the foregoing is considered as illustrative only of the principles of the sanitary handle apparatus. Further, since numerous modifications and changes will readily occur to those skilled in the art, it is not desired to limit the sanitary handle apparatus to the exact construction and operation shown and described, and accordingly, all suitable modifications and equivalents may be resorted to, falling within the scope of the sanitary handle apparatus.

What is claimed is:

1. A sanitary handle apparatus, comprising:

a rectangular mount flange fastened to an existing door with latch;

a cylindrical base affixed to an exterior of the flange;

a rotary cylinder rotatably attached to the base;

a cap removably fitted to the rotary cylinder;

a latch drive in communication with the rotary cylinder and the door latch, whereby rotary movement of the cylinder activates the door latch;

an electric motor disposed within the base;

a power source in communication with the motor;

a drive pin with an axial key rotatably driven by the motor;

a removable sleeve having a length, a keyway axially disposed within the sleeve, whereby the sleeve is slideably fitted to the drive pin and key;

a tubular handle affixed to the rotary cylinder, a gap in the handle;

a rod fitted within the handle, a curved loop of the rod exposed via the gap;

a protective cover for the rod, the cover disposed on the sleeve, the cover advanced over the rod by the motor, the cover returned to the sleeve as a used cover;

a light sensor disposed in the flange, the sensor in communication with a processor whereby the motor is activated to dispose the protective cover onto the rod to replace a used cover disposed on the curved loop of the rod.

2. The apparatus according to claim 1 wherein the cover and the used cover are further disposed separately on the sleeve.

3. A sanitary handle apparatus, comprising:

a rectangular mount flange fastened to an existing door with latch;

a cylindrical base affixed to an exterior of the flange;

a rotary cylinder rotatably attached to the base;

a cap removably fitted to the rotary cylinder;

a latch drive in communication with the rotary cylinder and the door latch, whereby rotary movement of the cylinder activates the door latch;

an electric motor disposed within the base;

a power source in communication with the motor;

a processor in communication with the power source and the motor;

a drive pin with an axial key rotatably driven by the motor;

a sleeve having a length, a keyway axially disposed within the sleeve, whereby the sleeve is slideably fitted to the drive pin and key;

a tubular handle affixed to the rotary cylinder, the handle further comprising:

a horizontal transverse affixed to the cylinder;

a return bend at a distal end of the transverse;

a return affixed to the cylinder adjacent to the transverse;

a curved bend extended from the return;

a gap between the return bend and the curved bend;

a rod fitted within the tubular handle, a space between the rod and the handle;

a curved loop disposed in the rod, the loop disposed outwardly at the gap of the tubular handle;

a protective cover for the rod, the cover disposed on the sleeve, the cover advanced over the rod by the motor, the cover returned to the sleeve as a used cover, the cover and used cover disposed separately on the sleeve;

a light sensor disposed in the flange, the sensor in communication with the processor whereby the motor is activated to dispose the protective cover onto the rod to replace used cover disposed on the curved loop of the rod.

* * * * *

UNITED STATES PATENT AND TRADEMARK OFFICE

CERTIFICATE OF CORRECTION

PATENT NO. : 7,716,789 B1
APPLICATION NO. : 12/242055
DATED : May 18, 2010
INVENTOR(S) : Emanuel F. Zevallos It is certified that error appears in the above-identified patent and that said Letters Patent is hereby corrected as shown below:

Title Page item 76
The inventor's name is spelled wrong. The inventor's name should read:

Emanuel F. Zevallos

Signed and Sealed this
Nineteenth Day of July, 2011

David J. Kappos

David J. Kappos
*Director of the United States Patent and Trademark Office*